US006871747B2

(12) United States Patent
Bustos

(10) Patent No.: US 6,871,747 B2
(45) Date of Patent: Mar. 29, 2005

(54) PRODUCT DISPLAY SHELVING ASSEMBLY

(75) Inventor: Rafael T. Bustos, Atlanta, GA (US)

(73) Assignee: L&P Property Management Company, South Gate, CA (US)

( * ) Notice: Subject to any disclaimer, the term of this patent is extended or adjusted under 35 U.S.C. 154(b) by 0 days.

(21) Appl. No.: 10/305,050

(22) Filed: Nov. 26, 2002

(65) Prior Publication Data

US 2004/0099619 A1 May 27, 2004

(51) Int. Cl.[7] ..... B42F 1/00

(52) U.S. Cl. ..... 211/50; 211/187; 211/118; 211/189

(58) Field of Search ..... 211/183, 117, 211/118, 189, 59.2, 119.003, 113, 90.01–90.04, 134, 153, 191, 188, 181.1; 108/92, 93, 149

(56) References Cited

U.S. PATENT DOCUMENTS

| | | | | | |
|---|---|---|---|---|---|
| 1,910,046 | A | | 5/1933 | Pascoe | |
| 3,229,822 | A | | 1/1966 | Janus | |
| 3,945,462 | A | * | 3/1976 | Griswold | 182/150 |
| 3,986,462 | A | * | 10/1976 | Heft | 108/188 |
| 4,061,092 | A | | 12/1977 | Jacobsen et al. | |
| 4,167,908 | A | * | 9/1979 | Jones et al. | 108/182 |
| 4,191,296 | A | * | 3/1980 | Morgan | 211/59.2 |
| 4,270,661 | A | * | 6/1981 | Rosenband | 211/59.2 |
| 4,343,245 | A | | 8/1982 | Edwards | |
| 4,424,908 | A | * | 1/1984 | Davitz | 211/118 |
| 4,426,008 | A | * | 1/1984 | Olson et al. | 211/59.2 |
| 4,456,125 | A | | 6/1984 | Chap | |
| 4,566,596 | A | * | 1/1986 | Hennig | 211/59.2 |
| 4,651,883 | A | * | 3/1987 | Gullett et al. | 211/59.2 |
| 4,886,171 | A | * | 12/1989 | Spamer | 211/59.2 |
| 4,890,748 | A | * | 1/1990 | Visser | 211/133.1 |
| 5,160,051 | A | * | 11/1992 | Bustos | 211/59.2 |
| 5,197,609 | A | | 3/1993 | Siegel | |
| 5,607,068 | A | * | 3/1997 | Coretti et al. | 211/59.2 |
| 5,779,068 | A | * | 7/1998 | Whiten et al. | 211/117 |
| 5,806,689 | A | * | 9/1998 | Mays et al. | 211/59.2 |
| 6,116,164 | A | | 9/2000 | Justen, Jr. | |
| 6,161,709 | A | | 12/2000 | Kluge et al. | |
| 6,220,461 | B1 | | 4/2001 | Dickinson | |
| 6,394,398 | B1 | * | 5/2002 | Reed et al. | 248/57 |
| 6,435,105 | B1 | | 8/2002 | Mikich et al. | |
| 6,497,331 | B1 | * | 12/2002 | Morandi | 211/153 |
| 6,688,478 | B2 | * | 2/2004 | Miller et al. | 211/59.2 |
| 2003/0160011 | A1 | * | 8/2003 | Langtry | 211/59.2 |

* cited by examiner

*Primary Examiner*—Carl D. Friedman
*Assistant Examiner*—Jennifer E. Novosad
(74) *Attorney, Agent, or Firm*—Michael Best & Friedrich LLP

(57) ABSTRACT

A product display shelving assembly according to some embodiments of the invention includes a pair of shelves in which one of the shelves is suspended from the other by a plurality of suspension pieces. Because the suspended shelf does not require a dedicated horizontal support member, a higher proportion of the shelving assembly's frontal area can be used for displaying products as compared to many types of conventional display shelving. More products can be thus displayed in a given space, less inventory needs to be warehoused and customers can shop more conveniently. The product display may be embodied in new shelving assemblies or conventional display shelving assemblies can be adapted with assembly structure according to the present invention.

51 Claims, 5 Drawing Sheets

PRODUCT DISPLAY SHELVING ASSEMBLY

FIELD OF THE INVENTION

This invention relates generally to shelving assemblies, and more particularly to product display shelving assemblies.

BACKGROUND OF THE INVENTION

Retail shelf space is valuable. Stores display retail products on shelves so that customers can inspect the products and select the ones that they will buy. Many customers make buying decisions while they are in the store, often quite literally within arm's reach of various competing products. In order for a product to be considered by these customers, it must be visible at the moment the buying decision is made. Without adequate, prominent retail shelf space, the product is effectively invisible.

The basic unit of shelf space is a square foot of display frontal area. Conventional display shelving assemblies may often include a rectangular shape having a vertical support member, known as an "upright," at each corner of the shelving assembly. The uprights are longitudinally connected via horizontal support members, referred to as "stretchers," and are laterally connected via reinforcing support members. While this arrangement has served for many years, the stretchers tend to waste frontal area. Every square foot of frontal area occupied by a stretcher represents lost sales opportunities.

A need exists for a new type of retail display shelving assembly that has a greater proportion of usable frontal area as compared to conventional shelving. Desirably, the new shelving assembly has fewer stretchers. More desirably, the new shelving assembly can be installed as an after-market accessory to upgrade conventional shelving assemblies.

SUMMARY OF THE INVENTION

The invention is a shelving assembly for displaying products to retail customers. The shelving assembly includes a suspended shelf that depends from another shelf by a plurality of suspension pieces. Because the suspended shelf does not require a dedicated horizontal support member, a higher proportion of the shelving assembly's frontal area can be used for displaying products as compared to many types of conventional display shelving. The suspension pieces are constructed as rigid members to lend stability to the shelves, and adjacent suspension pieces can be joined together to make the shelves even more stable. The suspension pieces may be fixed to the shelves or the shelving frame by fasteners, or the suspension pieces may include curves or angles that wrap around the shelves or the shelving frame. Conventional shelving assemblies can be upgraded to include the invention.

In one embodiment, the invention is a product display shelving assembly adapted to support a product. The shelving assembly includes at least two spaced uprights and a stretcher extending laterally between the uprights. The stretcher and/or the uprights support an upper shelf. A lower shelf is positioned below the upper shelf and suspended from the upper shelf by a plurality of suspension pieces.

The suspension pieces may be, for example, rigid metal brackets or bands that attach to the shelves via fasteners. Alternatively, the suspension pieces may include hooks for capturing a shelf or a stretcher.

In another embodiment, the invention is a kit for upgrading a conventional shelving assembly to include a suspended shelf. The invention also provides a method for assembling the display assembly of the invention and a method for upgrading a conventional shelving assembly to include the invention.

One advantage of the present invention is that additional merchandising space is created, as compared to the merchandising space of a comparatively sized, conventional product display shelving assembly. Using fewer stretchers than are required by conventional product display shelving assemblies creates the additional display space. The additional display space can be used for adding more shelves or for increasing the number of products displayed per shelf.

BRIEF DESCRIPTION OF THE DRAWINGS

The present invention is further described with reference to the accompanying drawings, which show preferred embodiments of the present invention. However, it should be noted that the invention as disclosed in the accompanying drawings is illustrated by way of example only. The various elements and combinations of elements described below and illustrated in the drawings can be arranged and organized differently to result in embodiments that are still within the spirit and scope of the present invention.

DETAILED DESCRIPTION OF THE PREFERRED EMBODIMENT

Figure 1:
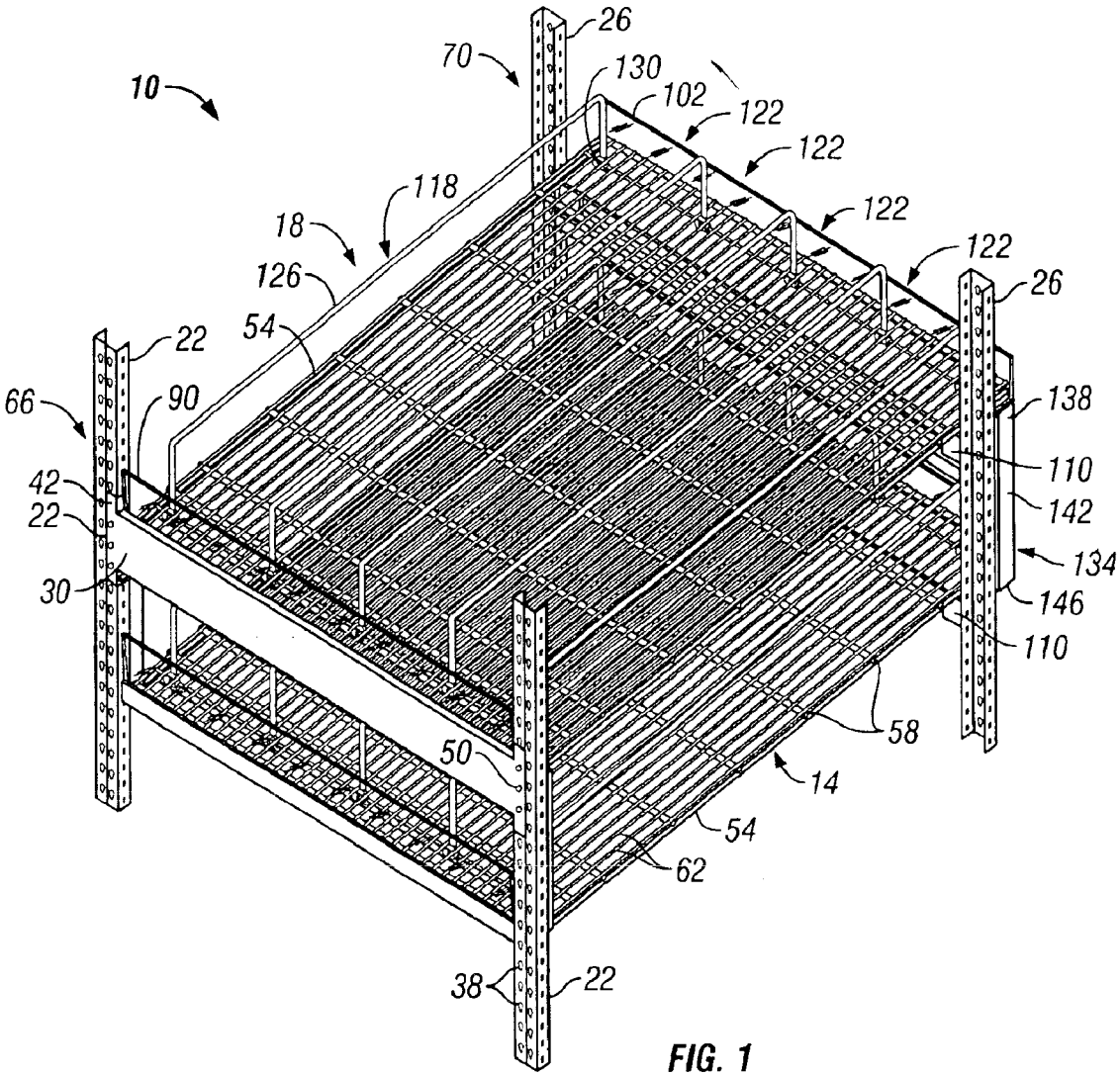
FIG. 1 is a perspective view of a product display shelving assembly embodying the present invention.

In a preferred embodiment, the invention is a product display shelving assembly or rack 10 as depicted in FIG. 1. Shelving assembly (rack) 10 includes front uprights 22 and rear uprights 26 vertically supporting upper shelf 18. Lower shelf 14 is suspended from upper shelf 18. Front and rear uprights 22, 26 are generally arranged in a rectangular configuration, with front uprights 22 and rear uprights 26 attached, respectively, by stretchers 30, 34 (best seen in FIG. 2). Uprights 22, 26 are substantially vertically extending support members, and stretchers 30, 34 are substantially horizontally extending support members.

Uprights 22, 26 include spaced apertures 38 along their lengths, and stretchers 30, 34 include mounting portions 42 having corresponding spaced apertures (FIG. 3) to line up with apertures 38 of uprights 22, 26 when stretchers 30, 34 are positioned on uprights 22. Ordinary fasteners 50 are passed through apertures 38 and apertures of mounting portions 42 to affix stretchers 30, 34 on uprights 22, 26. In other embodiments of the invention, stretchers 30, 34 utilize other components and methods to couple to uprights 22, 26 including nails, keys, protrusions, fingers, screws, pins, rivets, D-rings, welding, brazing, soldering and the like. Also, in yet other embodiments of the invention, more or fewer uprights 22, 26 and/or stretchers 30, 34 may be used to support upper shelf 18.

As shown in FIG. 1, upper and lower shelves 18, 14 each have wire frames 54, which are constituted by a plurality of longitudinally and laterally extending wires 58, 62, respectively. Alternatively, other types of shelves can be utilized in the invention, such as sheet metal or plastic shelves with a solid surface. Longitudinally extending wires 58 are interconnected with laterally extending wires 62 by, for example, welding, brazing, soldering, wrapping or the like. Wires 58, 62 are coated with a nonstick covering, such as paint, to help decrease any frictional forces developed at the surface of wire frame 54. Alternatively, the nonstick covering may be a hard rubber or plastic.

Figure 2:
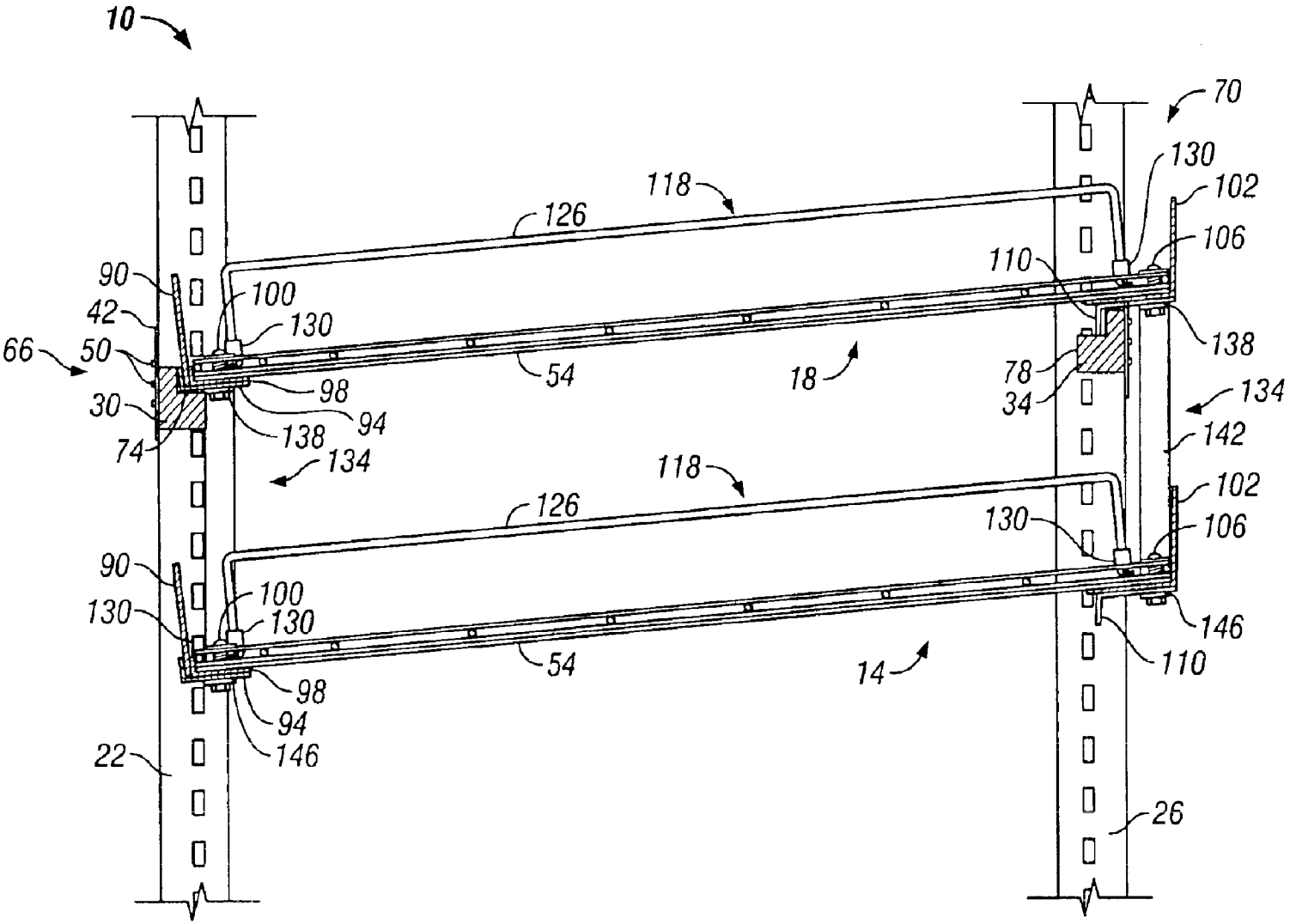
FIG. 2 is a side view of the shelving assembly of FIG. 1.

As shown in FIG. 2, shelves 14, 18 each have a front end 66 and a back end 70. Front stretcher 30 supports front end 66 on front stretcher support portion 74, and back stretcher 34 supports back end 70 on back stretcher support portion 78. As shown in FIGS. 1–2, front and back stretcher support portions 74, 78 include notches formed in front and back stretchers 30, 34, respectively. Front and back stretchers 30, 34 are attached to uprights 22 in a manner that places the notches in stretchers 30, 34 in a facing relationship. Accordingly, front end 66 of upper shelf 18 is positioned and supported within the notch of front stretcher 30, and back end 70 of upper shelf 18 is supported by the notch of back stretcher 34. In other embodiments of the invention, stretcher support portions 74, 78 may include, for example, brackets, hinges, mounting tabs, interference fits, snap-fits or the like.

As illustrated in FIG. 2, front stretcher 30 is mounted at a lower elevation relative to back end 70 so that upper shelf 18 is inclined at an angle relative to the floor or other support surface (not shown) supporting shelving assembly 10. Lower shelf 14 is inclined at an angle similar to that of upper shelf 18. As products are positioned on shelves 14, 18, the inclines tend to slide the products to front end 66 so that the products are more visible and available to customers. Alternatively, horizontal shelves can be utilized in the invention.

To prevent products from falling from front end 66, front guard member 90 is attached to wire frame 54. As shown in FIG. 2, front guard member 90 is attached substantially perpendicularly to front end 66. Alternatively, front guard member 90 may be attached to front end 66 at any reasonable angle relative to wire frame 54, such that front guard member 90 helps prevent the products from falling from the front of shelves 14, 18.

Front guard member 90 is preferably made from a clear plastic material, such as polycarbonate. Alternatively, front guard member 90 may be made of any transparent and/or translucent material that permits customers to view the products on shelves 14, 18. Front guard member 90 may be utilized to support signs that convey information about the product, such as price.

Figure 3:
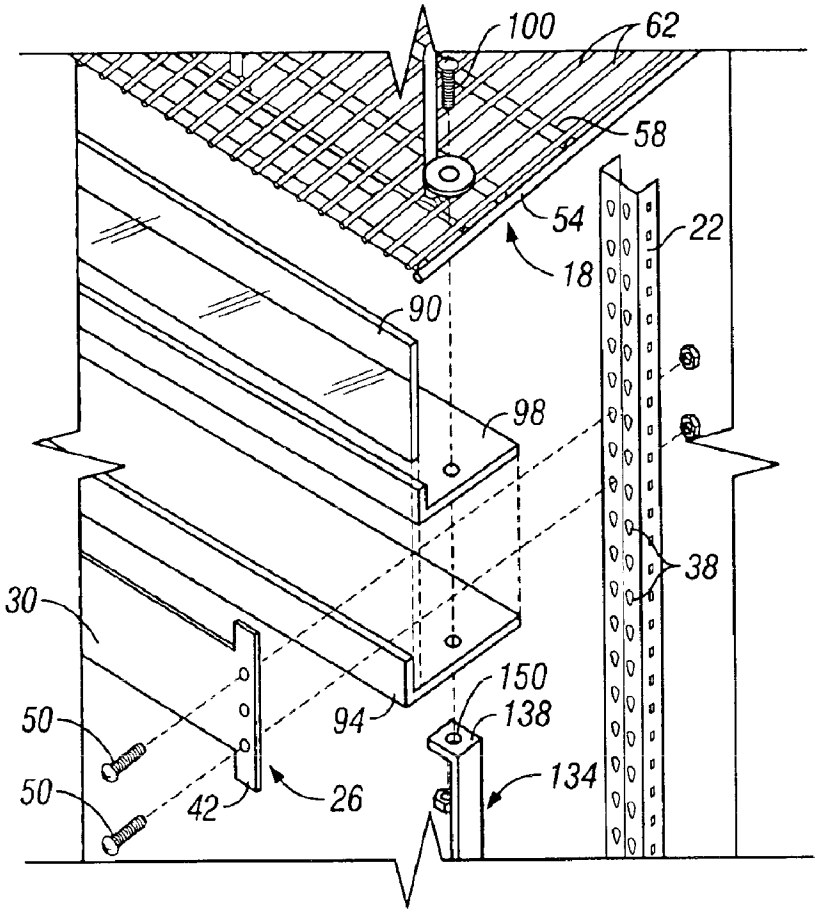
FIG. 3 is an enlarged, exploded view of the front corner of the shelving assembly of FIG. 1.

As can be seen in FIG. 3, front guard member 90 is clamped between first guard member bracket 94 and a second guard member bracket 98. Like guard member 90, first and second guard member brackets 94, 98 extend the length of shelves 14, 18. Guard member 90 is secured between first and second guard member brackets 94, 98, such that second guard member 98 lies above first guard member 94 and is attached between first guard member 94 and wire frame 54. First and second guard member brackets 94, 98 can be welded together or are fastened to wire frame 54 by fasteners 100 or by interference-fit, snap-fit or the like.

Figure 4:
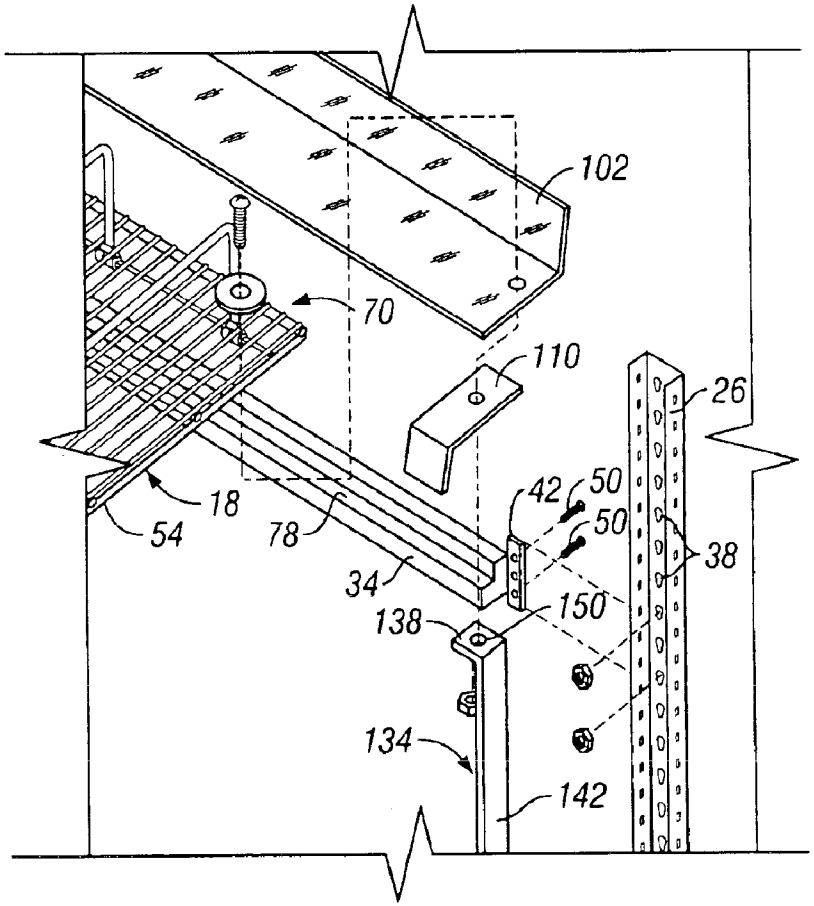
FIG. 4 is an enlarged, exploded view of the back corner of the shelving assembly of FIG. 1.

Turning now to FIG. 4, back guard member 102 is attached to back end 70 of wire frame 54 to help prevent the products from falling from the back of shelves 14, 18. Like front guard member 90, back guard member 102 extends the length of shelves 14, 18. However, back guard member 102 is usually made of opaque metal rather than clear plastic.

Back support bracket 110 is also attached to back end 70 of wire frame 54, as depicted in FIG. 4. Back support brackets 110 support back end 70 on back stretcher support portion 78. Back support brackets 110 include a slot (not shown) allowing back support brackets 110 to laterally adjust on wire frame 54 to accommodate the change in length caused by changes in the relative vertical positions of front and back stretchers 30, 34.

Continuing with FIG. 2, a plurality of wire guide members 118 extend laterally along wire frames 54 of shelves 14, 18 for organizing products on shelves 14, 18 into a product line 122 (best seen in FIG. 1). Wire guide members 118 include resilient, "C-shaped" wire 126, with the ends of wire 126 coupling to guide member retainers 130. Wire guide members 118 are preferably releasably attached to wire frame 54 and may therefore be adjusted thereon to fit the products carried on shelves 14, 18.

Wire guide members 118, working in combination with coated and inclined wire frame 54, promote "self-facing" of the products on shelves 14, 18. When, for example, a customer removes a first product from product line 122, guide members 118 and inclined shelves 14, 18 cooperate to slide the next product in product line 122 forward on wire frame 54 so that the customer can see and reach the next product in product line 122.

As can be seen in FIG. 2, suspension brackets 134 couple lower shelf 14 to upper shelf 18 for suspending lower shelf 14 from upper shelf 18. Suspension brackets 134 include upper mounting portion 138, middle portion 142 and lower mounting portion 146. Upper and lower mounting portions 138, 146 are substantially perpendicular to middle portion 142. Upper and lower mounting portions 138, 146 are substantially planar and parallel to each other. The mounting portions 138, 146 include apertures 150 (FIGS. 3 and 4) for fastening upper mounting portion 138 to upper shelf 18 and lower mounting portion 146 to lower shelf 14 using fasteners 100, 106. As shown in FIG. 3, upper mounting portions 138 are fastened to upper shelf 18 together with first and second guard member brackets 94, 98 at front end 66. As shown in FIG. 4, upper mounting portions 138 are fastened to upper shelf 18 together with back support brackets 110 and back guard member 102 at back end 70. Similarly, FIG. 2 illustrates that lower mounting portions 146 are fastened to lower shelf 14 together with first and second guard member brackets 94, 98 at front end 66, and lower mounting portions 146 are fastened to lower shelf 14 together with back support brackets 110 and back guard member 102 at back end 70 of lower shelf 14. Alternatively, suspension brackets 134 may be riveted, pinned, welded, brazed or the like to shelves 14, 18.

In FIG. 2, suspension brackets 134 are preferably made from steel and are sized to hold lower shelf 14 substantially parallel to upper shelf 18. In other embodiments of the invention, lower shelf 14 is not substantially parallel with upper shelf 18. In that case, suspension brackets 134 may be designed and/or configured to provide a different suspension angle to lower shelf 14.

Suspending lower shelf 14 from supported upper shelf 18 helps to free more merchandising space on shelving assembly or rack 10. More specifically, removing stretchers 30, 34 from lower shelf 14 improves space utilization and permits a higher proportion of shelving frontal area to be used for displaying products. Typically, stretchers 30, 34 are about 3 to about 5 inches tall and several feet long. By removing stretchers 30, 34, the frontal area previously occupied by stretchers 30, 34 is freed to display additional products. In many instances, two front stretchers 30 and two rear stretchers 34 can be replaced by two suspended shelves 14 so as to free about 6 to about 10 inches of vertical merchandising space along the length of shelving assembly or rack 10 for displaying additional products. The additional space can be used for adding display shelves or for displaying more products per shelf.

Figure 5:
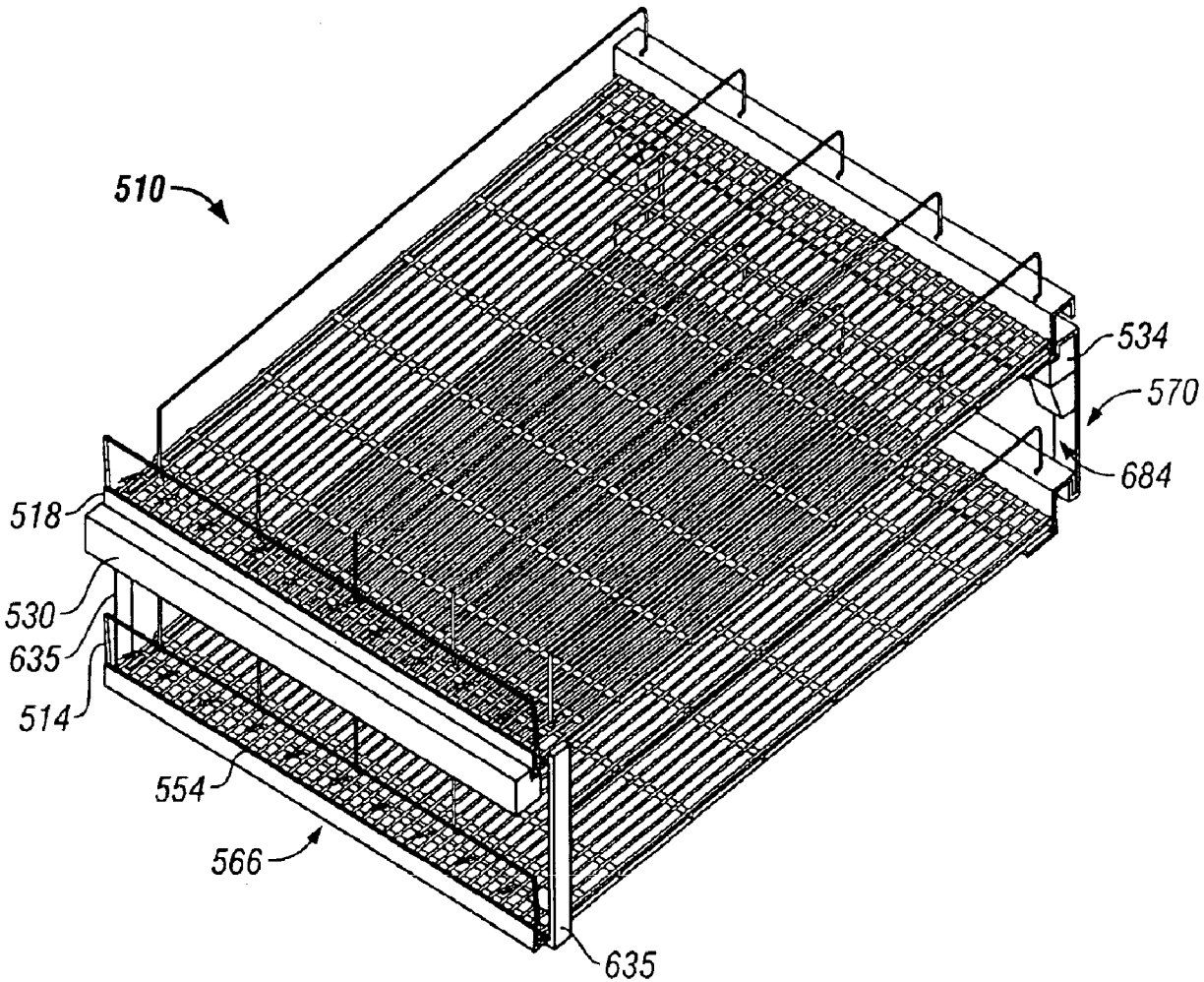
FIG. 5 is a perspective view of another product display shelving assembly embodying the present invention.
Figure 6:
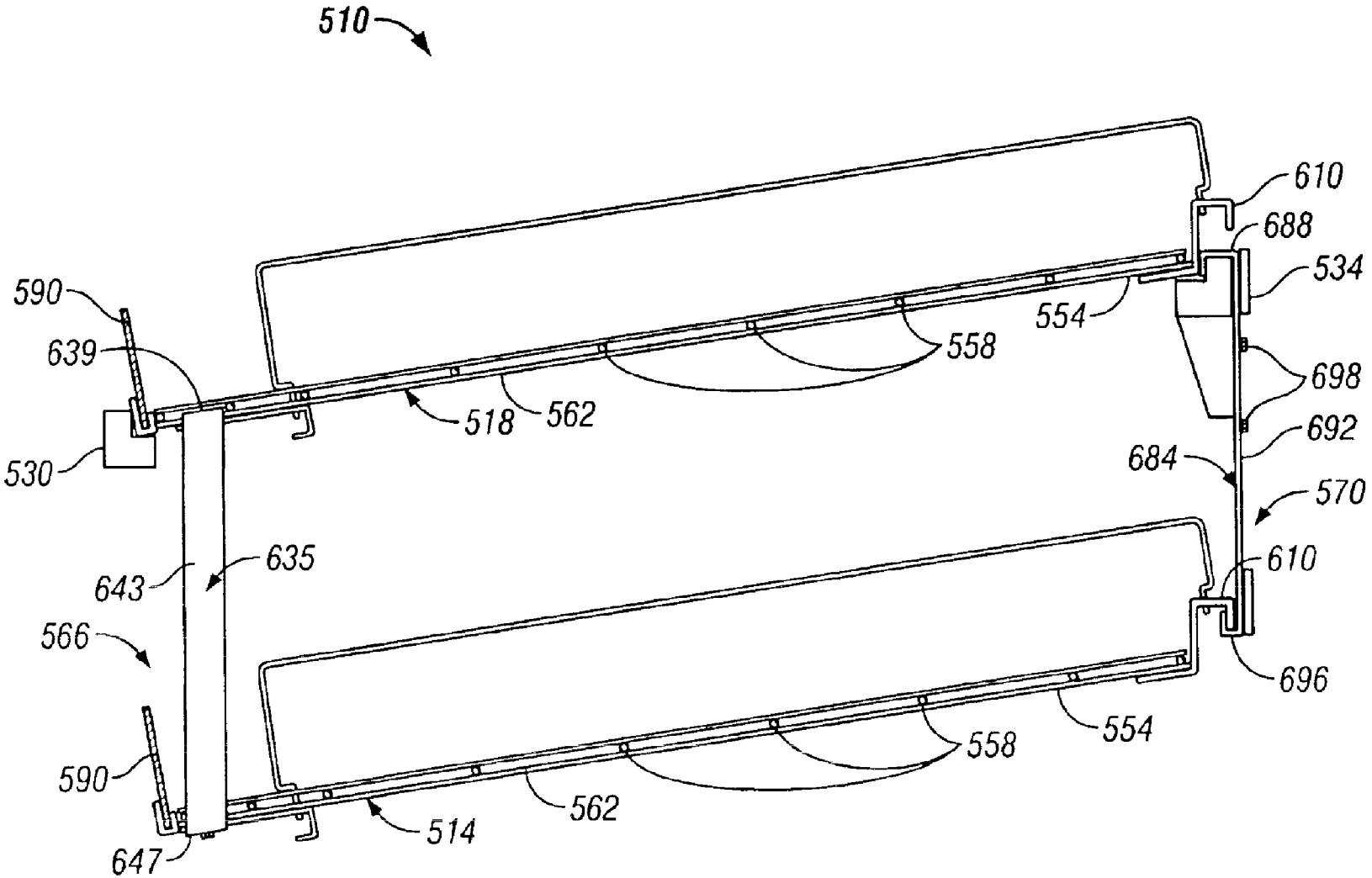
FIG. 6 is a side view of the shelving assembly of FIG. 5.

Another preferred embodiment of the invention is depicted in FIGS. 5 and 6. Elements depicted in FIGS. 5 and 6 having numbers 500 units greater than the numbers of similar elements in FIGS. 1–4 correspond to those elements and conform to their descriptions. For example, upper shelf 518 in FIG. 5 corresponds to upper shelf 18 in FIG. 1 and conforms to its description. As another example, the number of front stretcher 530 in FIG. 5 is 500 units greater than the number for front stretcher 30 in FIG. 1.

Turning now to FIG. 5, upper shelf 518 is mounted on front stretcher 530 and rear stretcher 534 of shelving assembly or rack 510. Lower shelf 514 is suspended from upper shelf 518 by front suspension pieces 635 and rear suspension pieces 684. Significantly, front and rear suspension pieces 635, 684 have several important differences as compared to suspension piece 134 depicted in FIG. 1.

FIG. 6 is a side view of the shelving assembly of FIG. 5. As can be seen in FIG. 6, front suspension piece 635 includes a middle portion 643, a first end portion 639 and a second end portion 647. Each of the end portions 639, 647 are curved or angled to form a hook suitable for holding and partially surrounding wire frame 554, more particularly, holding and surrounding longitudinal wires 562 of upper shelf 518 and lower shelf 514, respectively. As depicted in FIG. 6, these hooks wrap around and secure upper and lower shelves 518, 514 without any need for fasteners, interference fits, welding, brazing or the like. Front suspension piece 635 preferably attaches to the front portions of upper and lower shelves 518, 514 at a distance sufficiently removed from front 566 so as not to obstruct or interfere with front stretcher 530, which supports upper shelf 518. Front suspension pieces 635 may optionally be secured to upper and lower shelves 518, 514 by fasteners in addition to the hooks.

Rear support piece 684 includes middle portion 692, first end portion 688 and second end portion 696. Each of the end portions 688, 696 is bent or angled to form a hook. Preferably, the hook of first end portion 688 is of appropriate size and shape to capture and partially surround rear stretcher 534. The hook of second end portion 696 is appropriately shaped to capture back plate 610 of lower shelf 514. Optionally, middle portion 692 includes apertures (not shown) that cooperate with fasteners 698 for additionally securing suspension 684 to rear stretcher 584. Preferably, two or more suspension pieces 534 are employed, each located adjacent one of the rear corners of shelving assembly or rack 510.

In both of the preferred embodiments described above, suspension pieces 134, 635, 684 are preferably distributed along the front 66, 566 and the rear 70, 570 of shelving assemblies 10, 510. If two suspension pieces 134, 635, 684 are located close to one another, they may be joined together by fasteners or the like to increase the rigidity and stability of the shelving assembly 10, 510. If more than one shelving assembly or rack 10, 510 of the present invention is positioned immediately adjacent another such shelving assembly or rack 10, 510, one or more suspension pieces 134, 634, 684 may be joined together with those of the other shelving assembly or rack 10, 510 in order to increase the overall rigidity and stability of the display.

The invention better utilizes display shelving space. By using the invention, additional display shelves can be included in a shelving assembly or more products can be displayed per shelf. With the benefit of the invention, more products can be displayed in a given floor space, less inventory needs to be warehoused and customers can shop more conveniently.

The preceding embodiments are to be regarded as illustrative of the invention. It will be apparent to those skilled in the art that modifications may be made without departing from the spirit and scope of the invention. These modifications are intended to be included within the scope of the invention, as set forth in the appended claims, and it is not intended that the invention be otherwise limited.

That which is claimed is:

1. A shelving assembly for displaying a product, the shelving assembly comprising:

two spaced uprights;

a stretcher extending laterally between and supported by the uprights and mountable at any one of a plurality of mounting positions on the uprights;

an upper shelf for mounting on the stretcher;

a plurality of rigid suspension pieces, each of the suspension pieces having a middle portion, a first end portion and a second end portion; and a lower shelf positioned below the upper shelf and suspended from the upper shelf or the stretcher by the suspension pieces.

2. The shelving assembly of claim 1 in which one of the suspension pieces has first and second end portions that are generally planar and substantially parallel to each other.

3. The shelving assembly of claim 1 in which one of the suspension pieces has first and second end portions that are generally planar and substantially perpendicular to the middle portion.

4. The shelving assembly of claim 1 in which one of the suspension pieces has first and second end portions that each define one of a hook or an aperture, the first end portion being attached to the upper shelf or the stretcher by the hook or a fastener cooperating with the aperture, and the second end portion being attached to the lower shelf by the hook or a fastener cooperating with the aperture.

5. The shelving assembly of claim 1 in which one of the suspension pieces has first and second end portions that each define an aperture, the first end portion being attached to the upper shelf by a fastener that cooperates with the first end portion aperture and the second end portion being attached to the lower shelf by a fastener that cooperates with the second end portion aperture.

6. The shelving assembly of claim 1 in which one of the suspension pieces is joined to another of the suspension pieces.

7. The shelving assembly of claim 1 in which the upper shelf includes a front end and a rear end, the front end having a lower elevation than the rear end when the upper shelf is mounted on the stretcher.

8. The shelving assembly of claim 1 in which the upper shelf includes a front end and a rear end, the front end having about the same elevation as the rear end when the upper shelf is mounted on the stretcher.

9. The shelving assembly of claim 1 in which the stretcher includes a support portion, the upper shelf being supported on the support portion when the upper shelf is mounted on the stretcher.

10. The shelving assembly of claim 1 in which multiple suspension pieces are attached to the upper shelf around an outer periphery of the upper shelf and attached to the lower shelf around an outer periphery of the lower shelf.

11. A shelving assembly for displaying a product, the shelving assembly comprising:

two spaced uprights;

a stretcher extending laterally between and supported by the uprights;

an upper shelf for mounting on the stretcher;

a plurality of rigid suspension pieces, each of the suspension pieces having a middle portion, a first end portion and a second end portion; and a lower shelf positioned below the upper shelf and suspended from the upper shelf or the stretcher by the suspension pieces;

wherein one of the suspension pieces has first and second end portions that each define an aperture, the first end portion being attached to the upper shelf by a fastener that cooperates with the first end portion aperture and the second end portion being attached to the lower shelf by a fastener that cooperates with the second end portion aperture.

12. The shelving assembly of claim 11 in which one of the suspension pieces has first and second end portions that are generally planar and substantially parallel to each other.

13. The shelving assembly of claim 11 in which one of the suspension pieces has first and second end portions that are generally planar and substantially perpendicular to the middle portion.

14. The shelving assembly of claim 11 in which one of the suspension pieces is joined to another of the suspension pieces.

15. The shelving assembly of claim 11 in which the upper shelf includes a front end and a rear end, the front end having a lower elevation than the rear end when the upper shelf is mounted on the stretcher.

16. The shelving assembly of claim 11 in which the upper shelf includes a front end and a rear end, the front end having about the same elevation as the rear end when the upper shelf is mounted on the stretcher.

17. The shelving assembly of claim 11 in which the stretcher includes a support portion, the upper shelf being supported on the support portion when the upper shelf is mounted on the stretcher.

18. The shelving assembly of claim 11 in which the stretcher can be mounted at any one of a plurality of mounting positions on the uprights.

19. The shelving assembly of claim 11 in which multiple suspension pieces are attached to the upper shelf around an outer periphery of the upper shelf and attached to the lower shelf around an outer periphery of the lower shelf.

20. A shelving assembly for displaying a product, the shelving assembly comprising:

two spaced uprights;

a stretcher extending laterally between and supported by the uprights;

an upper shelf for mounting on the stretcher;

a plurality of rigid suspension pieces, each of the suspension pieces having a middle portion, a first end portion and a second end portion; and a lower shelf positioned below the upper shelf and suspended from the upper shelf or the stretcher by the suspension pieces;

wherein multiple suspension pieces are attached to the upper shelf around an outer periphery of the upper shelf and attached to the lower shelf around an outer periphery of the lower shelf.

21. The shelving assembly of claim 20 in which one of the suspension pieces has first and second end portions that are generally planar and substantially parallel to each other.

22. The shelving assembly of claim 20 in which one of the suspensions pieces has first and second end portions that are generally planar and substantially perpendicular to the middle portion.

23. The shelving assembly of claim 20 in which one of the suspension pieces has first and second end portions that each define one of a hook or an aperture, the first end portion being attached to the upper shelf or the stretcher by the hook or a fastener cooperating with the aperture, and the second end portion being attached to the lower shelf by the hook or a fastener cooperating with the aperture.

24. The shelving assembly of claim 20 in which one of the suspension pieces has first and second end portions that each define an aperture, the first end portion being attached to the upper shelf by a fastener that cooperates with the first end portion aperture and the second end portion being attached to the lower shelf by a fastener that cooperates with the second end portion aperture.

25. The shelving assembly of claim 20 in which one of the suspension pieces is joined to another of the suspension pieces.

26. The shelving assembly of claim 20 in which the upper shelf includes a front end and a rear end, the front end having a lower elevation than the rear end when the upper shelf is mounted on the stretcher.

27. The shelving assembly of claim 20 in which the upper shelf includes a front end and a rear end, the front end having about the same elevation as the rear end when the upper shelf is mounted on the stretcher.

28. The shelving assembly of claim 20 in which the stretcher includes a support portion, the upper shelf being supported on the support portion when the upper shelf is mounted on the stretcher.

29. The shelving assembly of claim 20 in which the stretcher can be mounted at any one of a plurality of mounting positions on the uprights.

30. A self-supporting shelving assembly for displaying a product, the shelving assembly comprising:

two spaced uprights adapted to rest upon and extend upwardly from a floor surface;

a stretcher extending laterally between and supported by the uprights;

an upper shelf for mounting on the stretcher;

a plurality of rigid suspension pieces, each of the suspension pieces having a middle portion, a first end portion and a second end portion; and a lower shelf positioned below the upper shelf and suspended from the upper shelf or the stretcher by the suspension pieces.

31. The shelving assembly of claim 30 in which one of the suspension pieces has first and second end portions that are generally planar and substantially parallel to each other.

32. The shelving assembly of claim 30 in which one of the suspension pieces has first and second end portions that are generally planar and substantially perpendicular to the middle portion.

33. The shelving assembly of claim 30 in which one of the suspension pieces has first and second end portions that each define one of a hook or an aperture, the first end portion being attached to the upper shelf or the stretcher by the hook or a fastener cooperating with the aperture, and the second end portion being attached to the lower shelf by the hook or a fastener cooperating with the aperture.

34. The shelving assembly of claim 30 in which one of the suspension pieces has first and second end portions that each define an aperture, the first end portion being attached to the upper shelf by a fastener that cooperates with the first end portion aperture and the second end portion being attached to the lower shelf by a fastener that cooperates with the second end portion aperture.

35. The shelving assembly of claim 30 in which one of the suspension pieces is joined to another of the suspension pieces.

36. The shelving assembly of claim 30 in which the upper shelf includes a front end and a rear end, the front end having a lower elevation than the rear end when the upper shelf is mounted on the stretcher.

37. The shelving assembly of claim 30 in which the upper shelf includes a front end and a rear end, the front end having about the same elevation as the rear end when the upper shelf is mounted on the stretcher.

38. The shelving assembly of claim 30 in which the stretcher includes a support portion, the upper shelf being supported on the support portion when the upper shelf is mounted on the stretcher.

39. The shelving assembly of claim 30 in which the stretcher can be mounted at any one of a plurality of mounting positions on the uprights.

40. The shelving assembly of claim 30 in which multiple suspension pieces are attached to the upper shelf around an outer periphery of the upper shelf and attached to the lower shelf around an outer periphery of the lower shelf.

41. A shelving assembly for displaying a product, the shelving assembly comprising:

two spaced uprights;

a stretcher extending laterally between and supported by the uprights;

an upper shelf for mounting on the stretcher;

a plurality of rigid suspension pieces, each of the suspension pieces having a middle portion, a first end portion and a second end portion; and a lower shelf positioned below the upper shelf and suspended from the upper shelf or the stretcher by the suspension pieces;

wherein the two spaced uprights extend to higher and lower elevations than the lower shelf.

42. The shelving assembly of claim 41 in which one of the suspension pieces has first and second end portions that are generally planar and substantially parallel to each other.

43. The shelving assembly of claim 41 in which one of the suspension pieces has first and second end portions that are generally planar and substantially perpendicular to the middle portion.

44. The shelving assembly of claim 41 in which one of the suspension pieces has first and second end portions that each define one of a hook or an aperture, the first end portion being attached to the upper shelf or the stretcher by the hook or a fastener cooperating with the aperture, and the second end portion being attached to the lower shelf by the hook or a fastener cooperating with the aperture.

45. The shelving assembly of claim 41 in which one of the suspension pieces has first and second end portions that each define an aperture, the first end portion being attached to the upper shelf by a fastener that cooperates with the first end portion aperture and the second end portion being attached to the lower shelf by a fastener that cooperates with the second end portion aperture.

46. The shelving assembly of claim 41 in which one of the suspension pieces is joined to another of the suspension pieces.

47. The shelving assembly of claim 41 in which the upper shelf includes a front end and a rear end, the front end having a lower elevation than the rear end when the upper shelf is mounted on the stretcher.

48. The shelving assembly of claim 41 in which the upper shelf includes a front end and a rear end, the front end having about the same elevation as the rear end when the upper shelf is mounted on the stretcher.

49. The shelving assembly of claim 41 in which the stretcher includes a support portion, the upper shelf being supported on the support portion when the upper shelf is mounted on the stretcher.

50. The shelving assembly of claim 41 in which the stretcher can be mounted at any one of a plurality of mounting positions on the uprights.

51. The shelving assembly of claim 41 in which multiple suspension pieces are attached to the upper shelf around an outer periphery of the upper shelf and attached to the lower shelf around an outer periphery of the lower shelf.

* * * * *